US005125620A

United States Patent [19]

Young

[11] Patent Number: 5,125,620

[45] Date of Patent: Jun. 30, 1992

[54] RAM TYPE BLOWOUT PREVENTER HAVING IMPROVED RAM FRONT PACKING

[75] Inventor: Kenneth D. Young, Kingwood, Tex.

[73] Assignee: Hydril Company, Houston, Tex.

[21] Appl. No.: 770,222

[22] Filed: Oct. 2, 1991

[51] Int. Cl.[5] ..... E21B 33/06

[52] U.S. Cl. ..... 251/1.3; 277/188 A

[58] Field of Search ..... 251/1.1, 1.3; 277/124, 277/188 A

[56] References Cited

U.S. PATENT DOCUMENTS 2,090,206 8/1937 King ..... 277/129 X 2,266,384 12/1941 Nea ..... 277/129 X 2,883,141 4/1959 Oliver ..... 277/129

*Primary Examiner*—John C. Fox

*Attorney, Agent, or Firm*—Vaden, Eickenroht, Thompson, Boulware & Feather

[57] ABSTRACT

There is disclosed a ram type blowout preventer whose rams have ram front packings which include seal strips of elastomeric material and top and bottom metal plates received in recesses across the front ends of the ram bodies, with the faces of the inner ends of the metal plates being slanted with respect to the vertical for sliding engagement with an oppositely slanting face of the inner end of the metal plate of an opposing ram.

12 Claims, 3 Drawing Sheets

RAM TYPE BLOWOUT PREVENTER HAVING IMPROVED RAM FRONT PACKING

This invention relates generally to ram type blowout preventers, and, more particularly, to improvements in the front packing for the rams of such preventers.

As well known in the art, blowout preventers comprise a housing installed at the head of an oil or gas well and having guideways extending from opposite sides of a vertical bore, and rams which are reciprocable within the guideways between positions opening and closing the bore. At least certain pairs of opposed rams are known as "pipe" rams in that they have vertical recesses in their front ends which seal with respect to a pipe in the bore as well as one another and with respect to the preventer housing to close off the annular space between the pipe and the bore and thus contain well fluid beneath the rams. Alternatively, the rams may be "blind rams" for closing an open bore in which case their inner ends do not have pipe recesses.

Conventionally, each ram comprises a metal body guidably slidable in its guideway and packing carried on the front end, sides and over the top of the ram body. The rams are moved between opened and closed positions by hydraulic operators, which, when the rams are closed, force the front packings tightly against one another (and a pipe in the bore in the case of pipe rams) with sufficient force to cause the packing to effect the desired seal.

The ram packing includes strips of rubber or other suitable elastomeric material received within recesses across the front end of the ram body and along the sides and over the top of the ram body so as to form a continuous seal. The ram front packing protrudes from the recess in the front end of the ram body to initially contact the front packing of the other ram, and of course a pipe in the bore in the case of pipe rams, and thereby energize the side and top packings into sealing engagement with the preventer body. The rams also include top and bottom metal plates which are received in the recess above and below the front packing so as to prevent extrusion of the elastomeric material between the ram bodies.

Although different pipes may be of the same nominal size, their outer diameters may vary because of manufacturing tolerances. Consequently, the pipe recesses formed in the front ends of the metal plates must be somewhat oversized and hence do not bridge the gap between them and the pipe. However, the rear ends of the plates are forced against portions of the seal strip behind them, as the front ends of the plates are engaged and forced against one another, to extrude the front faces of the seal strips against one another.

It has been found, however, that there is a tendency for the seal strips to be extruded between the vertical faces on the opposite front ends of the metal plates. This not only damages the seal strips, but also may prevent the front ends of the plates from engaging even in areas where the seal strips has not extruded between them. As a result, it may not be possible to form a sufficiently good seal between the front packings of opposed rams so as to contain well pressure below them.

It is therefore the object of this invention to provide blowout preventers whose rams have ram front packings of such construction as to reduce if not eliminate this tendency.

This and other objects are accomplished, in accordance with the illustrated embodiment of the invention, by rams having front packings in which the front ends of the metal plates of each ram have faces which, rather than being vertical as in the case of conventional rams, are slanted with respect to the vertical for engaging matching but oppositely slanted faces on the front ends of the metal plates of the opposing ram as the rams are moved to closed positions. Hence, the faces vertically overlap one another when the rams are closed so that portions of the seal strip which might otherwise be extruded between them would have to follow a less direct path. Moreover, the lower of the overlapping faces will be urged by well fluid beneath the closed rams upwardly against the upper face so as to tend to close any gap which might otherwise exist between them.

In the illustrated embodiment of the invention, the rams have vertical recesses to receive and seal about a pipe in the bore of the preventer body. Thus, the slanted faces are formed only on the front ends of the plates on opposite sides of the recess. In the preferred embodiment of the invention, the face of each plate is slanted oppositely to the face on the other side of the pipe recess. Thus, the top and bottom plates of both rams may be of the same construction to reduce manufacturing and inventory costs.

More particularly, the face of each upper plate on one side of the pipe recess is slanted oppositely to the face of each lower plate on the same side of the recess. Consequently, as the faces slide over one another, they wedge the plates away from one another and thus tightly against the oppositely facing surfaces of the ram guideway.

In the drawing wherein like reference characters are used throughout the designate like parts:

FIG. 1 is a view partly in vertical section and partly in elevation of a blowout preventer constructed in accordance with the present invention and with a well pipe extending through the bore thereof and the rams of the preventer withdrawn to open positions, FIG. 2 is a view similar to FIG. 1, but with the rams moved inwardly to close about the pipe and the vertical section being taken through the rams to one side of the pipe recess therein, as in FIGS. 5 and 6;

Figure 1:
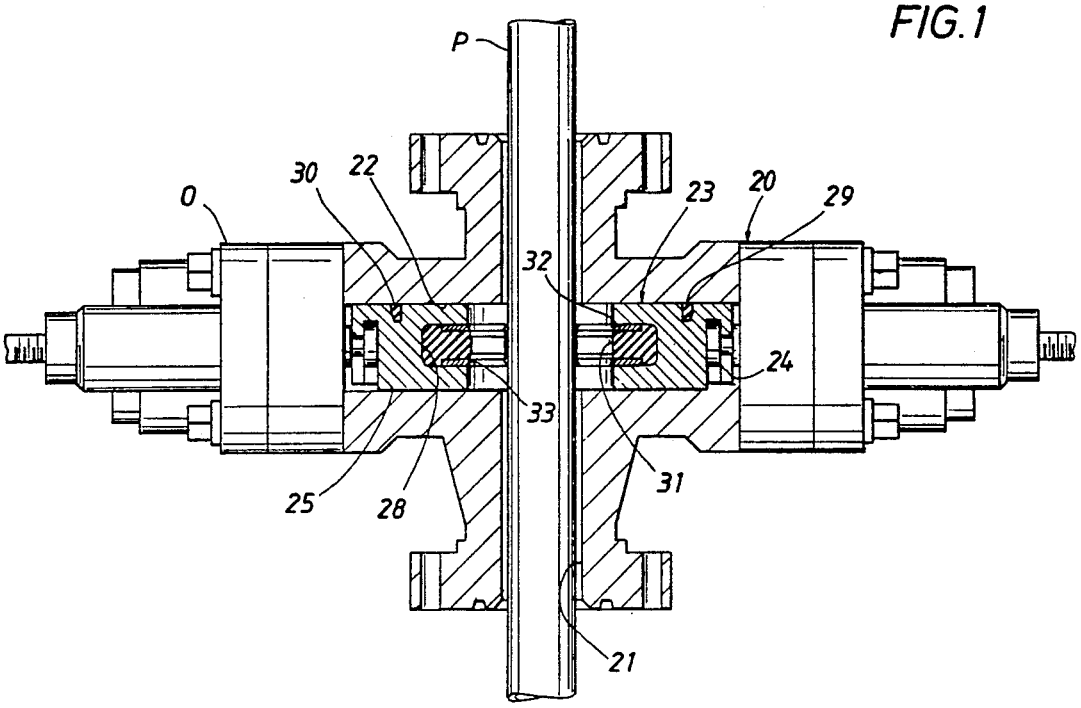
Figure 2:
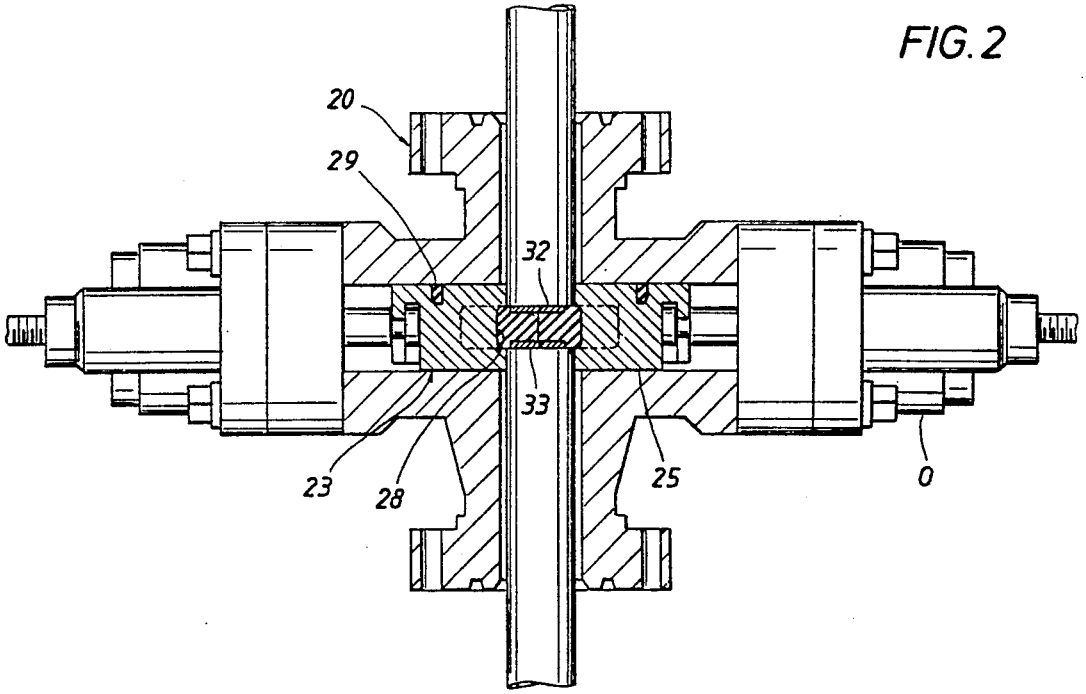

With reference now to the details of the above described drawings, the overall blowout preventer is shown in FIGS. 1 and 2 to comprise a housing 20 having a bore 21 extending vertically therethrough and guideways 22 extending horizontally outwardly from opposite sides of the bore. Flanges about the bore at the upper and lower ends of the preventer housing permit it to be installed at the head of a well, to receive a pipe P through the bore, which may be a drill pipe extending into the well.

The preventer further includes rams 23 each slidable within a guideway for movement between outer positions to open the bore, as shown in FIG. 1, and inner positions to close the bore, as shown in FIG. 2. As previously described, the rams 23 are "pipe" type rams for sealing about the pipe P in the bore 21 as well as with respect to one another and the blowout preventer housing. The rams are moved between open and closed positions by operators O connected across the open outer ends of the guideways.

Each ram 23 comprises a metal ram body 25 closely slidable within a guideway 22 in the preventer housing, and having its outer end being connected to the piston of the hydraulic operator 0 by means of a part on the inner end of the piston rod for movement with it. The ram further includes packing carried by the ram body across its front face as well as along its sides and over the top for sealably engaging not only with respect to the pipe P in the preventer housing bore, but also with respect to the opposing ram and the preventer housing including the guideways.

Figure 3:
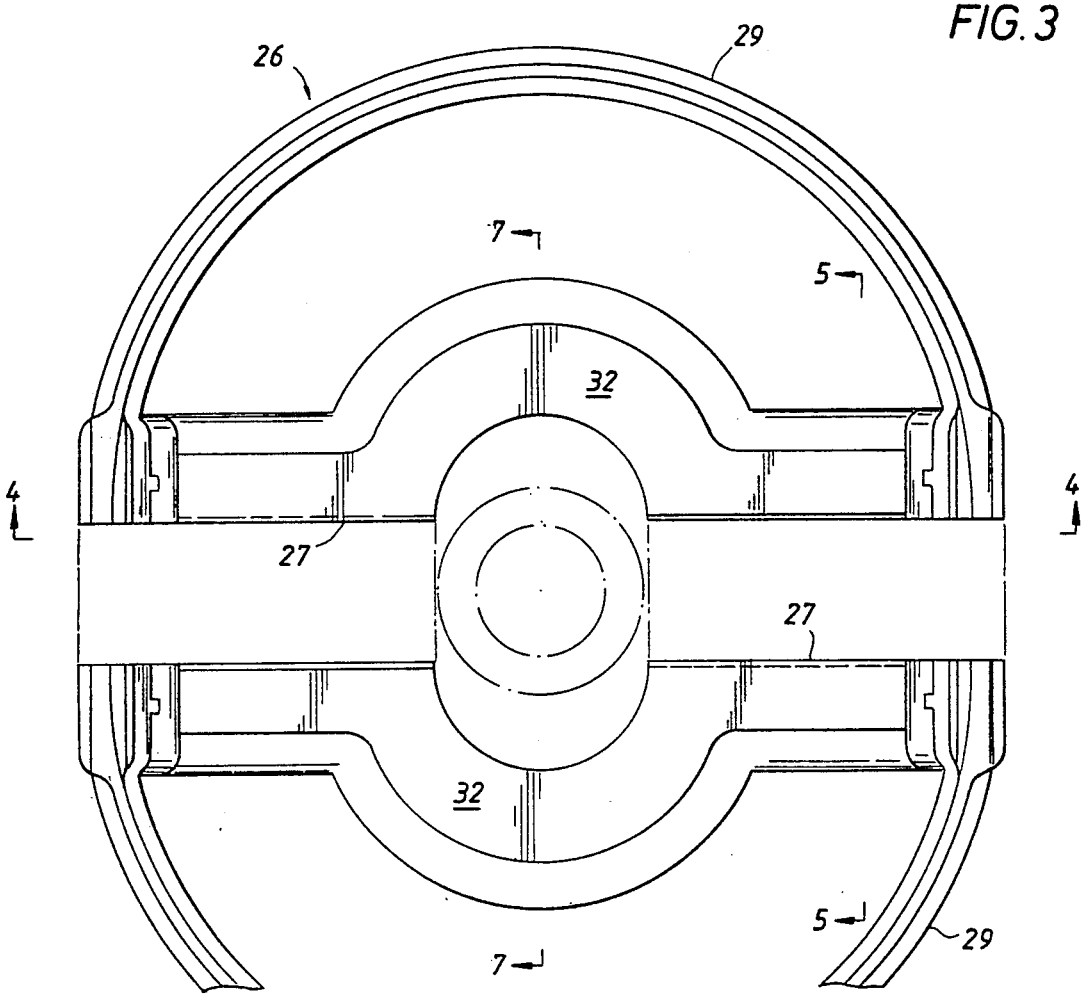
FIG. 3 is a top plan view of the packings of the rams removed from the ram bodies and spaced from one another.
Figure 4:
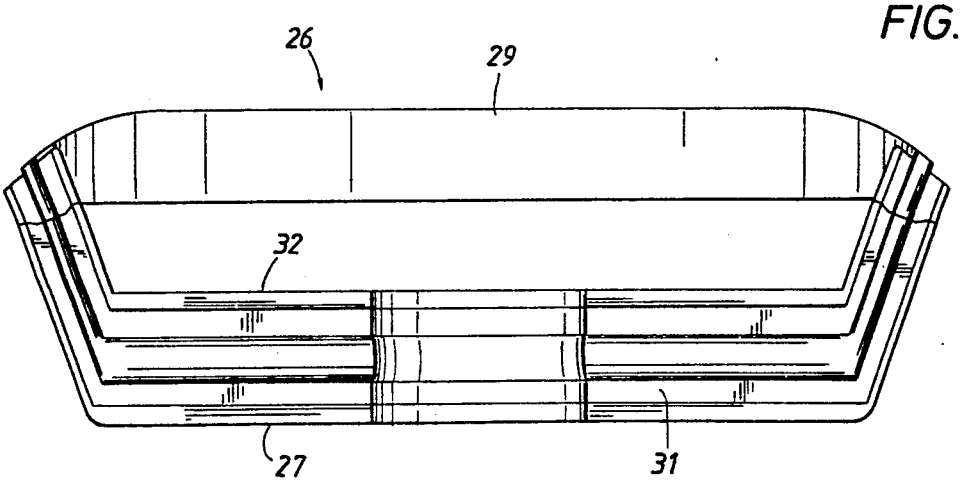
FIG. 4 is a front view of one of the ram packings, as seen along broken lines 4—4 of FIG. 3.

This packing, which is shown in its entirety in FIGS. 3 and 4, includes a front portion 27 disposed within a recess 28 across the front face of the ram body and side and top portion 29 received within a recess 30 extending across the top of the ram body. More particularly, the side and top recess and the packing received therein are of semi-circular shape to connect to their front ends with the opposite ends of the ram front packing.

Figure 7:
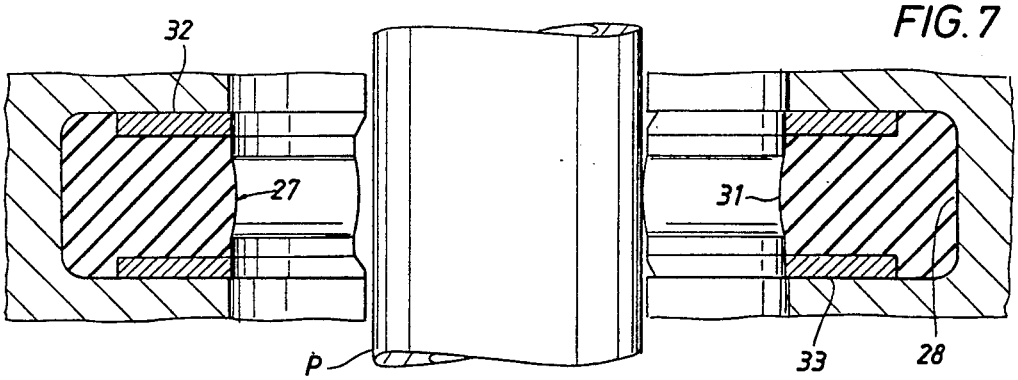
FIG. 7 is an enlarged vertical sectional view of a portion of the rams and front packings, in open position, and as seen along the broken lines 7—7 of FIG. 3.
Figure 8:
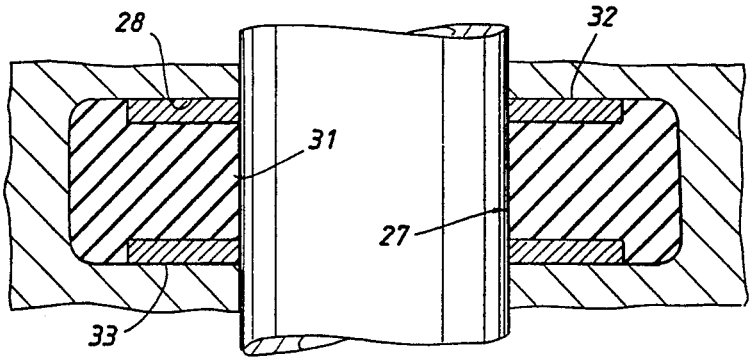
FIG. 8 is a view similar to FIG. 7 but upon movement of the rams to closed positions.

Each ram front packing includes a strip 31 of rubber or other suitable elastomeric material received within the recess and extending laterally thereacross and then upwardly at its opposite ends for connection with the ends of the top packing 29. The ram front packing 27 also includes upper and lower plates 32 and 33 received in the recess above and below the seal strip 31. As shown in FIGS. 7 and 8, the front ends of the seal strip 31 and metal pipes 32 protrude slightly from the front ends of the ram bodies on which they are carried.

The front ends of each of the ram bodies and ram packings including the seal strip 27 and the upper and lower plates 33 are provided with aligned vertical recesses intermediate their opposite sides. More particularly, the recesses are formed in the rams diametrically opposite one another and are of a size for fitting about the pipe P when the rams are moved to closed position, thus enabling the ram packing to seal not only with respect to that of the other ram and the blowout preventer housing, but also with respect to the pipe.

As previously described, the upper and lower plates 32 and 33 do not extend rearwardly all the way to the inner end of the recess 28. Thus, portions of the seal strip 27 are disposed behind the rear ends of the metal plates, so that, as the rams are moved inwardly to cause the inner ends of the metal plates to engage with one another, the inner ends of the seal strips are extended outwardly to tightly engage one another and about the pipe.

In accordance with the novel aspects of the present invention, and as previously described, the inner ends of the metal plates on opposite sides of the recess therein have faces which are slanted with respect to the vertical in a direction opposite to that of the slanting faces of the inner ends of the metal plates of the other ram with which they are adapted to engage so that the metal faces overlap one another as the inner ends of the rams are moved to closed position, thus tending to prevent extrusion of the elastomeric material of the strips between the faces.

More particularly, as indicated in FIG. 3, the front faces of each plate on opposite sides of the recess slant in opposite directions with respect to one another. That is, as shown in FIG. 3, the front faces on the left hand side of the recesses of the upper metal plate 32 slant upwardly and outwardly, while those on the right hand side of the recess slant inwardly and downwardly. Consequently, and as previously mentioned, the same plates may be used for both rams, one being merely reversed with respect to the other. However, although not illustrated, it will be understood that, in the case of blind rams, the faces of the plates would be slanted in one direction from one side to the other of the ram.

Figure 5:
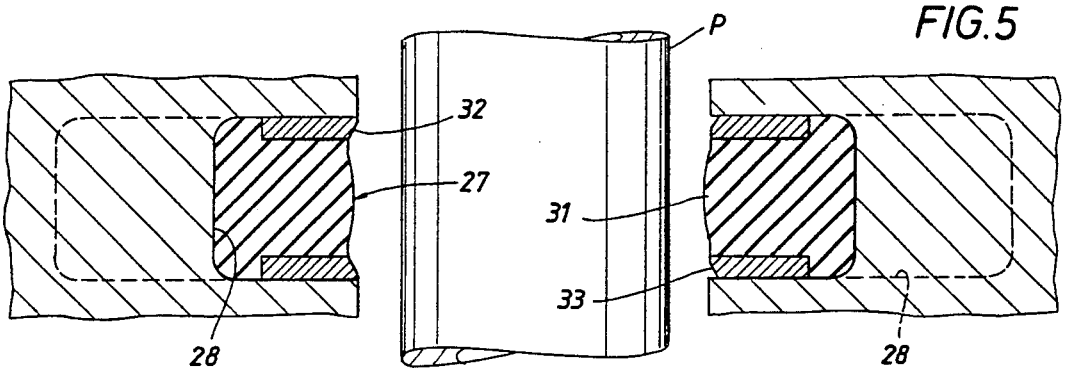
FIG. 5 is an enlarged vertical sectional view of a portion of the rams and front packings thereof as seen along broken lines of 5—5 of FIG. 3.
Figure 6:
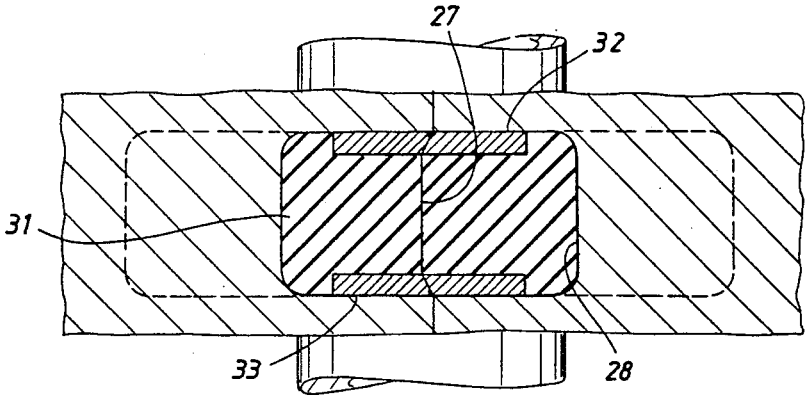
FIG. 6 is another view of a portion of the rams and the ram front packings, like FIG. 5, but with the rams moved to closed position.

More particularly, and as best shown in FIGS. 5 and 6, the faces of both plates of the left hand ram on one side of their pipe recesses extend oppositely to one another. In like manner, the faces of both plates of the right hand ram on the same side of their pipe recesses also extend opposite to one another. Thus, as previously mentioned, the upper and lower plates of the left hand ram are wedged upwardly and downwardly, respectively, against the opposite surfaces of the guideways.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blowout preventer, comprising a housing having a vertical bore and opposed guideways extending from the bore, and rams reciprocable within the guideways for opening and closing the bore, each ram including a body guidably slidable in a guideway, and means carried by the ram body for sealing with respect to the opposed ram as well as with respect to the preventer housing, when the rams are moved to closed position, said sealing means including a ram front packing received within a recess across the front face of the ram body and having a seal strip of elastomeric material, and top and bottom metal plates respectively above and below the seal strips for preventing extrusion of the seal strips between the front ends of the ram bodies, the elastomeric seal strip including portions behind the metal plates, so that, upon engagement of the front ends of the plates with one another, during closing movement of the rams, the front ends of the seal strips are urged tightly against one another, and the front ends of the metal plates of each ram having faces which are slanted with respect to the vertical for slidably engaging oppositely slanted faces on the front ends of the metal plates of the opposing ram as the rams are moved to closed position.

2. A blowout preventer of the character defined in claim 1, wherein the front ends of the ram body, seal strips and metal plates have vertical recesses therein to fit and seal about a pipe in the bore of the preventer housing, and the slanted faces are on the front ends of the plates on each side of the recess.

3. A blowout preventer of the character defined in claim 2, wherein the face of each plate on one side of the pipe recess being slanted oppositely to the face on the other side of the pipe recess.

4. A blowout preventer of the character defined in claim 2, wherein the face of each upper plate on each side of the pipe recess being slanted oppositely to the face of each lower plate on the same side of the pipe recess.

5. A blowout prevent ram, comprising a ram body guidably slidable in a guideway of the housing of a blowout preventer which extends from a vertical bore in the housing, and means carried by the ram body for sealing with respect a ram in an opposed guideway as well as with respect to the preventer body, when the opposed rams are moved inwardly to close the bore, said sealing means including a ram front packing received within a recess across the front face of the ram body and having a seal strip of elastomeric material and top and bottom metal plates respectively above and below the seal strips for preventing extrusion of the seal strips between the front ends of the ram bodies, the elastomeric seal strip including portions behind the rear ends of the metal plates, so that, upon engagement of the front ends of the plates with one another, during closing movement of the rams, the front ends of the seal strips are urged tightly against one another, and the front ends of the metal plates having faces which are slanted with respect to the vertical for slidably engaging oppositely slanted faces on the front ends of the metal plates of the opposing ram as the rams are moved to closed position.

6. A ram of the character defined in claim 5, wherein the front ends of the ram body, seal strips and metal plates have vertical recesses therein to fit and seal about a pipe in the bore of the preventer housing, and the slanted faces are on the front ends of the plates on each side of the recess.

7. A blowout preventer of the character defined in claim 6, wherein the face of each plate on one side of the pipe recess being slanted oppositely to the face on the other side of the pipe recess.

8. A blowout preventer of the character defined in claim 7, wherein the face of each upper plate on each side of the pipe recess being slanted oppositely to the face of each lower plate on the same side of the pipe recess.

9. For use in a blowout preventer ram having a body guidably slidable in a guideway which extends from a bore of the housing of a blowout preventer, a ram front packing disposable within a recess across the front face of the ram body, comprising a seal strip of elastomeric material, and top and bottom metal plates respectively above and below the seal strips for preventing extrusion of the seal strips between the front ends of the bodies of opposed rams, the elastomeric seal strip including portions behind the metal plates, so that, upon engagement of the opposed front ends of the plates with one another, during closing movement of the opposed rams, the front ends of the seal strips are urged tightly against one another, and the front ends of the metal plates of each ram having faces which are slanted with respect to the vertical for slidably engaging oppositely facing slanted faces on the front ends of the metal plates of the opposing ram as the rams are moved to closed position.

10. A ram front packing of the character defined in claim 9, wherein, the front ends of the ram body, seal strips and metal plates have vertical recesses therein to fit and seal about a pipe in the bore of the preventer housing, and the slanted faces are on the front ends of the plates on each of the recess.

11. A blowout preventer of the character defined in claim 10, wherein the face of each plate on one side of the pipe recess being slanted oppositely to the face on the other side of the pipe recess.

12. A blowout preventer of the character defined in claim 11, wherein the face of each upper plate on each side of the pipe recess being slanted oppositely to the face of each lower plate on the same side of the pipe recess.

* * * * *